US009055816B2

(12) United States Patent
Panno, Jr.

(10) Patent No.: US 9,055,816 B2
(45) Date of Patent: Jun. 16, 2015

(54) COLLAPSIBLE EASEL

(76) Inventor: Nicholas J. Panno, Jr., Stow, OH (US)

( * ) Notice: Subject to any disclaimer, the term of this patent is extended or adjusted under 35 U.S.C. 154(b) by 431 days.

(21) Appl. No.: 13/284,877

(22) Filed: Oct. 29, 2011

(65) Prior Publication Data

US 2013/0105659 A1 May 2, 2013

(51) Int. Cl.
*A47B 97/08* (2006.01)

(52) U.S. Cl.
CPC ..... *A47B 97/08* (2013.01)

(58) Field of Classification Search
USPC ..... 248/441.1, 443, 444, 449, 442.2, 447, 248/460, 461, 458; 211/41.7, 198, 202; 40/607.04, 610
See application file for complete search history.

(56) References Cited

U.S. PATENT DOCUMENTS

| | | | | | |
|---|---|---|---|---|---|
| 391,608 | A | * | 10/1888 | Hartwell | 248/449 |
| 1,308,956 | A | | 7/1919 | Krauth | |
| 1,570,973 | A | * | 1/1926 | Simonelli | 248/449 |
| 3,399,925 | A | * | 9/1968 | Levy | 297/156 |
| 3,408,767 | A | | 11/1968 | Anderson | |
| 4,165,856 | A | * | 8/1979 | Wiseheart | 248/449 |
| 4,325,197 | A | | 4/1982 | Achten | |
| 4,372,630 | A | | 2/1983 | Fuhri | |
| 4,690,363 | A | * | 9/1987 | Koves | 248/449 |
| 4,819,902 | A | | 4/1989 | Wenger | |
| 5,016,852 | A | | 5/1991 | Herendeen | |
| 5,662,303 | A | | 9/1997 | Rellinger | |
| 5,950,979 | A | | 9/1999 | Mira | |
| 6,264,161 | B1 | | 7/2001 | Waggoner | |
| 6,334,687 | B1 | | 1/2002 | Chino | |
| 6,601,805 | B1 | | 8/2003 | Kapp | |
| 6,772,987 | B2 | | 8/2004 | Jones, II | |
| D502,964 | S | | 3/2005 | Cziraky | |
| 6,870,672 | B2 | | 3/2005 | Stumpfl | |
| 6,873,458 | B1 | | 3/2005 | Bakkom | |
| 7,118,084 | B2 | | 10/2006 | Park | |
| 7,178,778 | B2 | | 2/2007 | Lee | |
| 7,188,818 | B2 | | 3/2007 | Chang | |
| 7,543,790 | B2 | | 6/2009 | Starcher | |
| 2007/0090265 | A1 | | 4/2007 | Fasano | |

* cited by examiner

*Primary Examiner* — Alfred J Wujciak
(74) *Attorney, Agent, or Firm* — Dominic Frisina

(57) ABSTRACT

Some embodiments generally relate to portable easel devices for supporting and/or displaying objects such as canvas, other paintable substrates, or even sheet music. Embodiments may include one or more collapsible elements rendering the device readily storable and/or easier to carry or transport.

6 Claims, 10 Drawing Sheets

COLLAPSIBLE EASEL

I. BACKGROUND OF THE INVENTION

A. Field of Invention

Some embodiments may generally relate to artistic support and/or display devices and methods.

B. Description of the Related Art

Currently, the field of artist easels includes various devices having support elements for securing canvases and the like. However, these devices, while adjustable, retain their relative size and shape. Although this may be inconsequential while painting in an art studio, it is problematic during travel. Not only is the easel large and cumbersome, but often space is limited. Accordingly, there is a need in the art for an easel that can readily and conveniently travel with the artist.

Some embodiments of the present invention may provide one or more advantages over the prior art.

II. SUMMARY OF THE INVENTION

Some embodiments may include an easel, comprising a main beam having a first end and a second end spaced apart from the first end and defining a length; a first support attached to an end of the main beam, the first support defining a first retaining trough, the first retaining trough running at least part of a length of the first support, and the first retaining trough being bounded at least by a portion of a face of the first support and a portion of a face of the main beam, wherein the first retaining trough is adapted to receive a work piece defined by an artist's canvas in a retaining relation; a second support attached to an end of the main beam opposing the end to which the first support is attached, the second support defining a second retaining trough, the second retaining trough running at least part of a length of the second support and the second retaining trough being bounded by at least a portion of a face of the second support and a portion of a face of the main beam, the shortest distance between the face of the second support and the face of the main beam defining a width of the second retaining trough, wherein the width of the second retaining trough is adjustable according to a width adjustment means, wherein the second retaining member is adapted to receive a work piece defined by an artist's canvas in a compressive retaining relation; and a base fixedly attached to an end of the main beam, the base having a first face in contact with the main beam and through which the base is attached to the main beam, and the base having a second face spaced apart from, and generally parallel to, the first face, wherein the second face further includes a means for receiving a stand in a supportive relation.

In some embodiments the main beam comprises a receiving member and a slide member, the receiving member defining, and at least partially enclosing, a slide retaining space adapted to receive the slide member in a slidable retaining relation, wherein the slide member can retract into the slide retaining space reducing the overall length of the main beam, and the slide member can extend out of the slide retaining space increasing the overall length of the main beam.

Some embodiments may further comprise a means for fixing the position of the slide member relative to the receiving member, thereby fixing the overall length of the main beam.

In some embodiments the main beam comprises a unitary member.

In some embodiments the first support comprises a unitary member attached to the main beam at a central point along a length of the first support.

In some embodiments the first support comprises a pair of supports each defining an inner end and an outer end, the pair of supports each being hingedly attached through their inner ends to the main beam at opposing sides of the main beam.

In some embodiments the second support comprises a unitary member attached to the main beam at a central point along the length of the second support.

In some embodiments the second support comprises a pair of supports each defining an inner end and an outer end, the pair of supports each being hingedly attached through their inner ends to the main beam at opposing sides of the main beam.

In some embodiments the first support comprises a first end-face and an opposing second end-face, and wherein one or more of the first and second end-faces defines a recess penetrating the end-face and extending into the support such that the recess is bounded on all sides by the first support and is only open at the first and/or second end-faces, wherein the recess is adapted to receive art implements.

Some embodiments further comprise a detachable platform having a supporting face adapted to receive items in a vertically supportive relation, and a joining edge adapted to reversibly engage the first support in a fixed relation.

Some embodiments comprise a main beam having a first end and a second end spaced apart from the first end, the main beam defining a length, wherein the main beam comprises a receiving member and a slide member, the receiving member defining, and at least partially enclosing, a slide retaining space adapted to receive the slide member in a slidable retaining relation, wherein the slide member can retract into the slide retaining space reducing the overall length of the main beam, and the slide member can extend out of the slide retaining space increasing the overall length of the main beam; a first support attached to an end of the main beam, the first support defining a first retaining trough, the first retaining trough running at least part of a length of the first support, and the first retaining trough being bounded at least by a portion of a face of the first support and a portion of a face of the main beam, wherein the first retaining trough is adapted to receive a work piece defined by an artist's canvas in a retaining relation, and wherein the first support comprises a pair of supports each defining an inner end and an outer end, the pair of supports each being hingedly attached through their inner ends to the main beam at opposing sides of the main beam; a second support attached to an end of the main beam opposing the end to which the first support is attached, the second support defining a second retaining trough, the second retaining trough running at least part of a length of the second support and the second retaining trough being bounded by at least a portion of a face of the second support and a portion of a face of the main beam, the shortest distance between the face of the second support and the face of the main beam defining a width of the second retaining trough, wherein the width of the second retaining trough is adjustable according to a width adjustment means, wherein the second retaining member is adapted to receive a work piece defined by an artist's canvas in a compressive retaining relation, and wherein the second support comprises a pair of supports each defining an inner end and an outer end, the pair of supports each being hingedly attached through their inner ends to the main beam at opposing sides of the main beam; and a base fixedly attached to an end of the main beam, the base having a first face in contact with the main beam and through which the base is attached to the main beam, and the base having a second face spaced apart from, and generally parallel to, the first face, wherein the second face further includes a means for receiving a stand in a supportive relation.

Some embodiments further comprise a means for fixing the position of the slide member relative to the receiving member, thereby fixing the overall length of the main beam.

In some embodiments the first support comprises a first end-face and an opposing second end-face, and wherein one or more of the first and second end-faces defines a recess penetrating the end-face and extending into the support such that the recess is bounded on all sides by the first support and is only open at the end-face, wherein the recess is adapted to receive art implements.

Some embodiments further comprise a detachable platform having a supporting face adapted to receive items in a vertically supportive relation, and a joining edge adapted to reversibly engage the first support in a fixed relation.

Some embodiments comprise a main beam selected from one or more of a unitary member, or a pair of telescoping members; a first support defining a length and attached to an end of the main beam, the first support and the main beam together defining a retaining trough therebetween; a second support defining a length and attached to an opposing end of the main beam, the second support and the main beam together defining a retaining trough therebetween, and a width of the retaining trough being adjustable; and a base fixedly attached to an end of the main beam and adapted to detachably receive a vertical support in a fixed relation.

In some embodiments the first support comprises a pair of supports each defining an inner end and an outer end, the pair of supports each being hingedly attached through their inner ends to the main beam at opposing sides of the main beam.

In some embodiments the second support comprises a pair of supports each defining an inner end and an outer end, the pair of supports each being hingedly attached through their inner ends to the main beam at opposing sides of the main beam.

In some embodiments the first support comprises a first end-face and an opposing second end-face, and wherein one or more of the first and second end-faces defines a recess penetrating the end-face and extending into the first support such that the recess is bounded on all sides by the first support and is only open at the first and/or second end-faces, wherein the recess is adapted to receive art implements.

Some embodiments further comprise a detachable platform having a supporting face adapted to receive items in a vertically supportive relation, and a joining edge adapted to reversibly engage the first support in a fixed relation.

According to some embodiments the first and second supports are hingedly joined to the main beam through a double hinge.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

According to one embodiment, a main beam has a first end and a second end spaced apart from the first end defining a length. The first end of the main beam is attached to a first support. The first support defines a first retaining trough bound by at least a portion of the first support and at least a portion of the main beam. This first retaining trough is adapted to receive work pieces such as, without limitation, an artist's canvas, other paintable substrates, or even sheet music. The second end of the main beam is attached to a second support. The second support defines a second retaining trough bound by at least a portion of the second support and at least a portion of the main beam. This second retaining trough is adapted to receive work pieces such as, without limitation, an artist's canvas. The first end of the main beam is fixedly attached to a base. The base has a first face in contact with the main beam and a second face opposite the first which includes a means for receiving a stand in a supportive relation.

In some embodiments, the main beam comprises a receiving member and a slide member. The receiving member defines a slide retaining space adapted to receive, and at least partially enclose, the slide member. The slide member can be retracted into the slide retaining space to decrease the overall length of the main beam. Conversely, the slide member can be extended from the slide retaining space to increase the overall length of the main beam. In some embodiments, a fastener can lock the slide member in place. One skilled in the art will appreciate that many different fasteners could be appropriate.

In some embodiments, the first support comprises a pair of supports in a mirrored relationship with each other and a hinged relationship with the main beam. Each of the pair of supports rotates on its respective hinges, in opposite directions, with a range of motion up to approximately 90 degrees relative to the main beam. This allows the first pair of supports to collapse during nonuse, for instance, while traveling or for storage. In some embodiments, the second support comprises a pair of supports in a mirrored relationship with each other and a hinged relationship with the main beam. Each of the pair of supports rotates on its respective hinges, in opposite directions, with a range of motion up to approximately 90 degrees relative to the main beam. This similarly allows the second pair of supports to collapse during nonuse.

Figure 1:
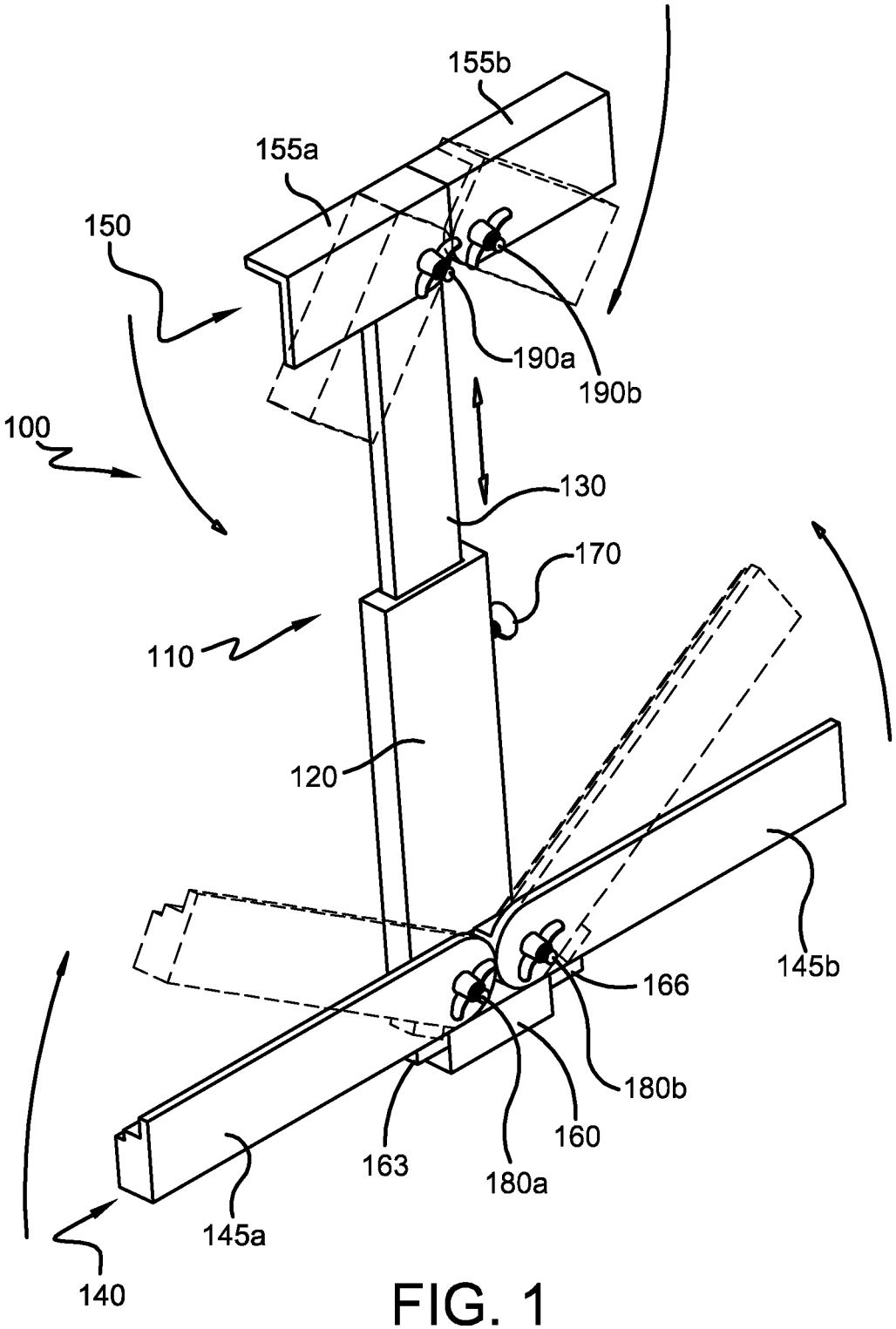
FIG. 1 is a perspective view of a collapsible embodiment.

Referring now to the drawings wherein the showings are for purposes of illustrating embodiments of the invention only and not for purposes of limiting the same, FIG. 1 is a drawing of an embodiment 100 having a main beam 110 comprising a receiving member 120 receiving a slide member 130 in a slidable relation. The embodiment of FIG. 1 also includes a first support 140 comprising a pair of supports

145*a*, 145*b* in a mirrored relation, each of which is hingedly fastened to the receiving member 120 at one end of the supports 145*a*, 145*b*. As further shown in FIG. 1, an embodiment can include a second support 150 comprising a pair of supports 155*a*, 155*b* in a mirrored relation, each of which is hingedly fastened to the slide member at one end. The embodiment of FIG. 1 further includes a base 160 fixedly attached to one end of the receiving member 120 and adapted to receive a tripod in a supportive relation. The main beam 110 can be lengthened by extending the slide member 130 outwardly from the receiving member 120. Conversely, the main beam 110 can be shortened by retracting the slide member 130 into the receiving member 120. A locking means 170 for fixing the length of the main beam 110, by locking the slide member 130 in a selected position, is disposed laterally on a side of the receiving member 120. According to FIG. 1, an embodiment includes hinges 180*a*, 180*b* joining the pair of supports 145*a*, 145*b* to the main beam 110 thereby forming the first support 140. Mechanical stops 163, 166 limit each of the supports' 145*a*, 145*b* range of motion to approximately 90 degrees relative to the main beam. One skilled in the art will recognize that mechanical stops 163 and 166 may become unnecessary if the supports 145*a* and 145*b* are level or if the base 160 is slightly wider than shown in FIG. 1. Similarly, according to FIG. 1 an embodiment also includes hinges 190*a*, 190*b* which join the pair of supports 155*a*, 155*b* to the main beam 110 thereby forming the second support 150.

Figure 2:
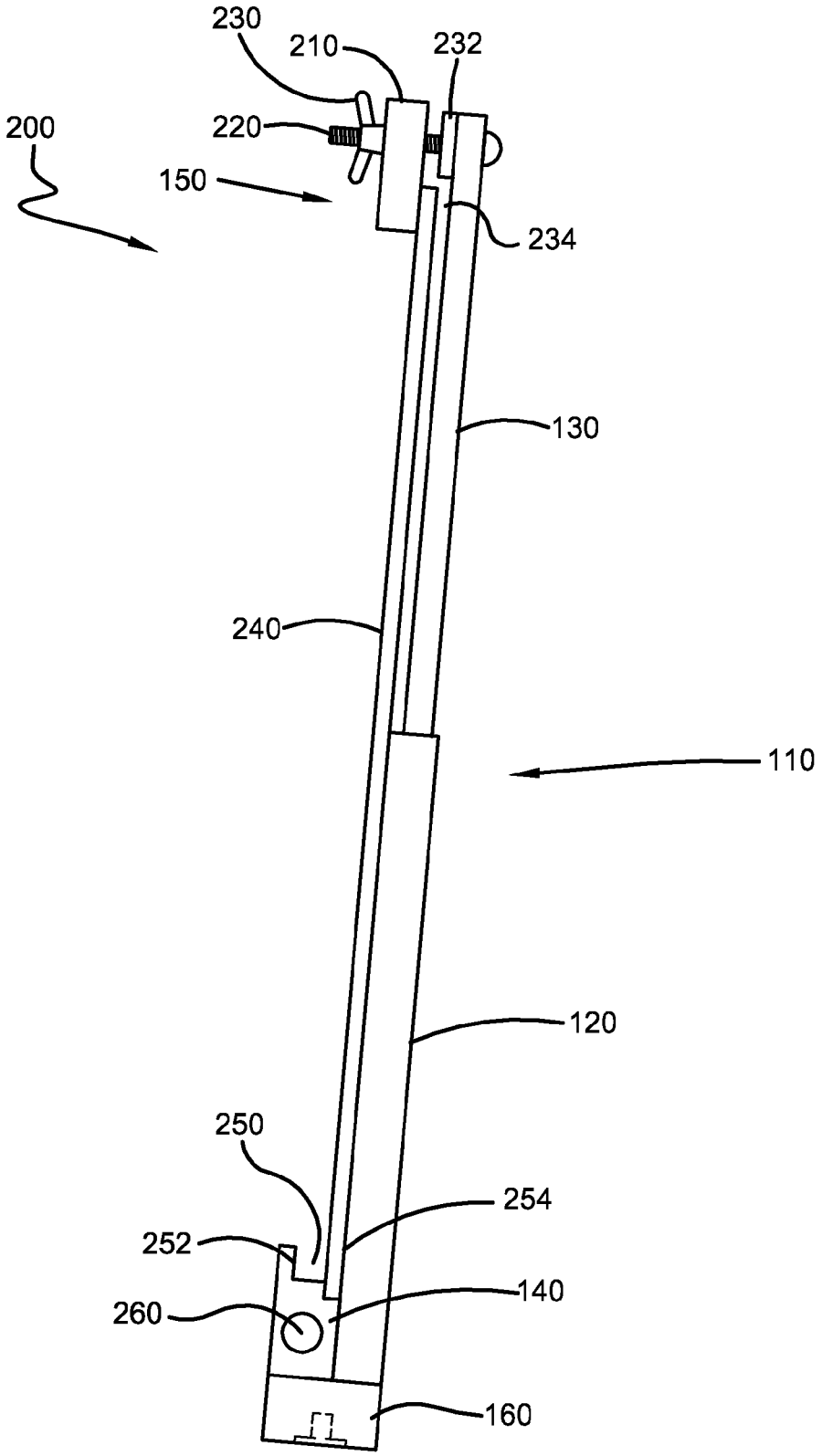
FIG. 2 is a side view of an embodiment.

FIG. 2 is a side view of an embodiment 200. According to FIG. 2, the second support 150 in this embodiment 200 comprises a retaining panel 210 positioned opposing the slide member 130. The retaining panel 210 is fastened to the slide member 130 by a threaded bolt 220 and secured with a wing nut 230. Accordingly, tightening the wing nut 230 draws the retaining panel 210 toward the slide member 130. Conversely, loosening the wing nut 230 on the threaded bolt 220 loosens the retaining panel 210 allowing it to slide away from the slide member 130. Here as throughout the specification and claims, one of skill in the art will recognize that the present invention is not limited to wing nuts and bolts as explicitly shown herein, but rather encompasses alternative structures performing substantially the same function in substantially the same way and with substantially the same effect. The embodiment of FIG. 2 also includes a spacer 232 between the retaining panel 210 and the slide member 130, which results in a second retaining trough 234. The second retaining trough 234 is defined by an inward facing portion of the retaining panel 210, and opposing portion of the slide member 130 and the spacer 232 therebetween.

The embodiment of FIG. 2 further includes a first retaining trough 250, defined by an inward facing portion 252 of the first support 140 and an inward facing portion 254 of the receiving member 120. The retaining trough 250 holds the artist's canvas 240 in a retaining relation in cooperation with the second retaining trough 234. Additionally, according to FIG. 2, recesses 260 in the first support 140 are adapted to receive art implements, such as but not limited to, paint brushes.

Figure 3:
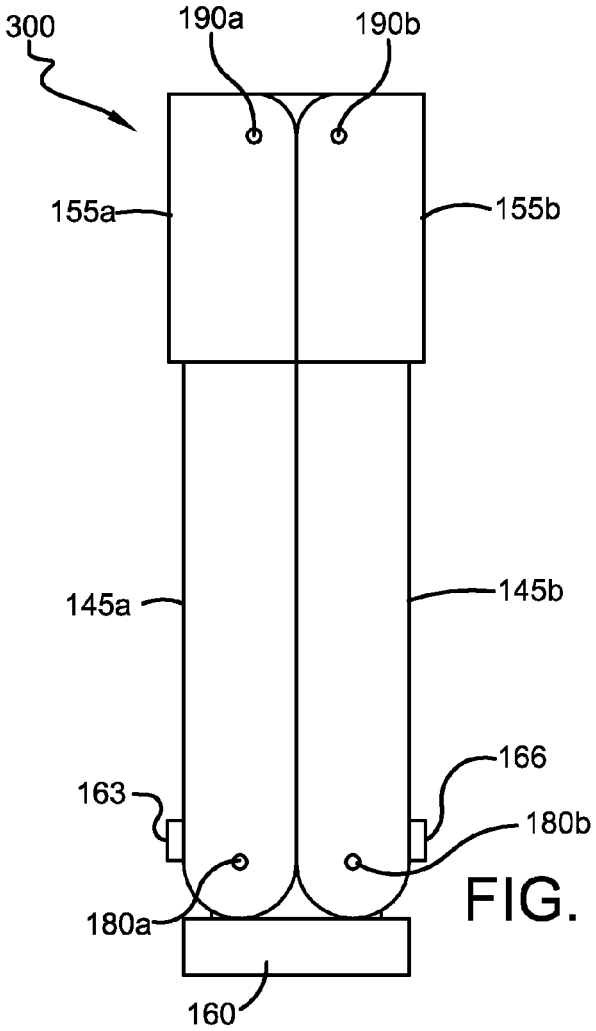
FIG. 3 is a view of a collapsed embodiment.

FIG. 3 is a frontal view of an embodiment 300 in a collapsed configuration. In the embodiment shown in FIG. 3, the pair of supports 145*a*, 145*b* comprising the first support 140 are each rotatable through approximately 90 degrees on hinges 180*a*, 180*b* towards the main beam 110. Likewise, the pair of supports 155*a*, 155*b* comprising the second support 150 are each rotatable through approximately 90 degrees on hinges 190*a*, 190*b* towards the main beam 110.

Figure 5:
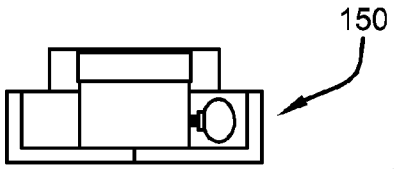
FIG. 5 is an above view of a second support of a collapsed embodiment.
Figure 6:
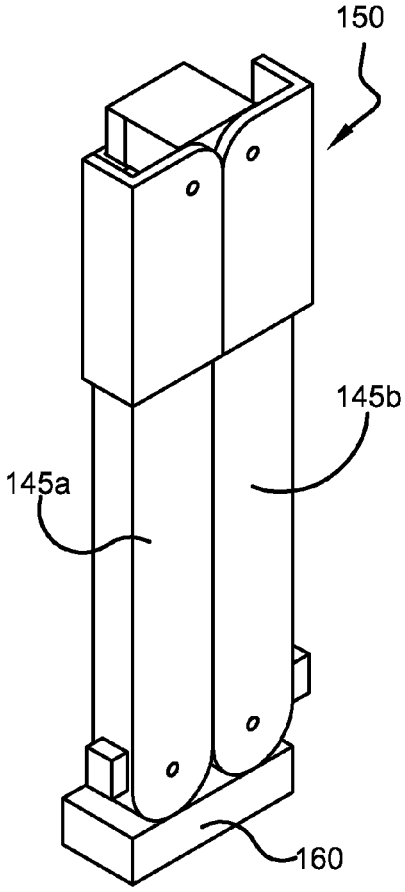
FIG. 6 is an perspective view of a collapsed embodiment.
Figure 4:
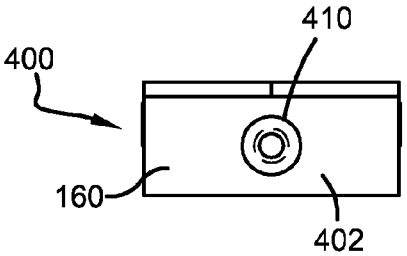
FIG. 4 is a view of a base of an embodiment.

FIG. 4 is a view 400 of a base 160 of embodiment 300 in a collapsed configuration. In this view 400, a means for receiving a stand 410, such as without limitation a tripod, is disposed in a surface 402 of the base 160. The surface 402 opposes the surface of the base which is affixed to the main beam 110. In some embodiments, the means for receiving a stand 410 comprises a threaded mount. In some alternative embodiments the receiving means 410 can comprise any of a variety of suitable structures known to those of skill in the art. FIG. 5 is a view of the second support 150 of embodiment 300 in a collapsed configuration. FIG. 6 is a perspective view of embodiment 300 in a collapsed configuration.

Figure 7:
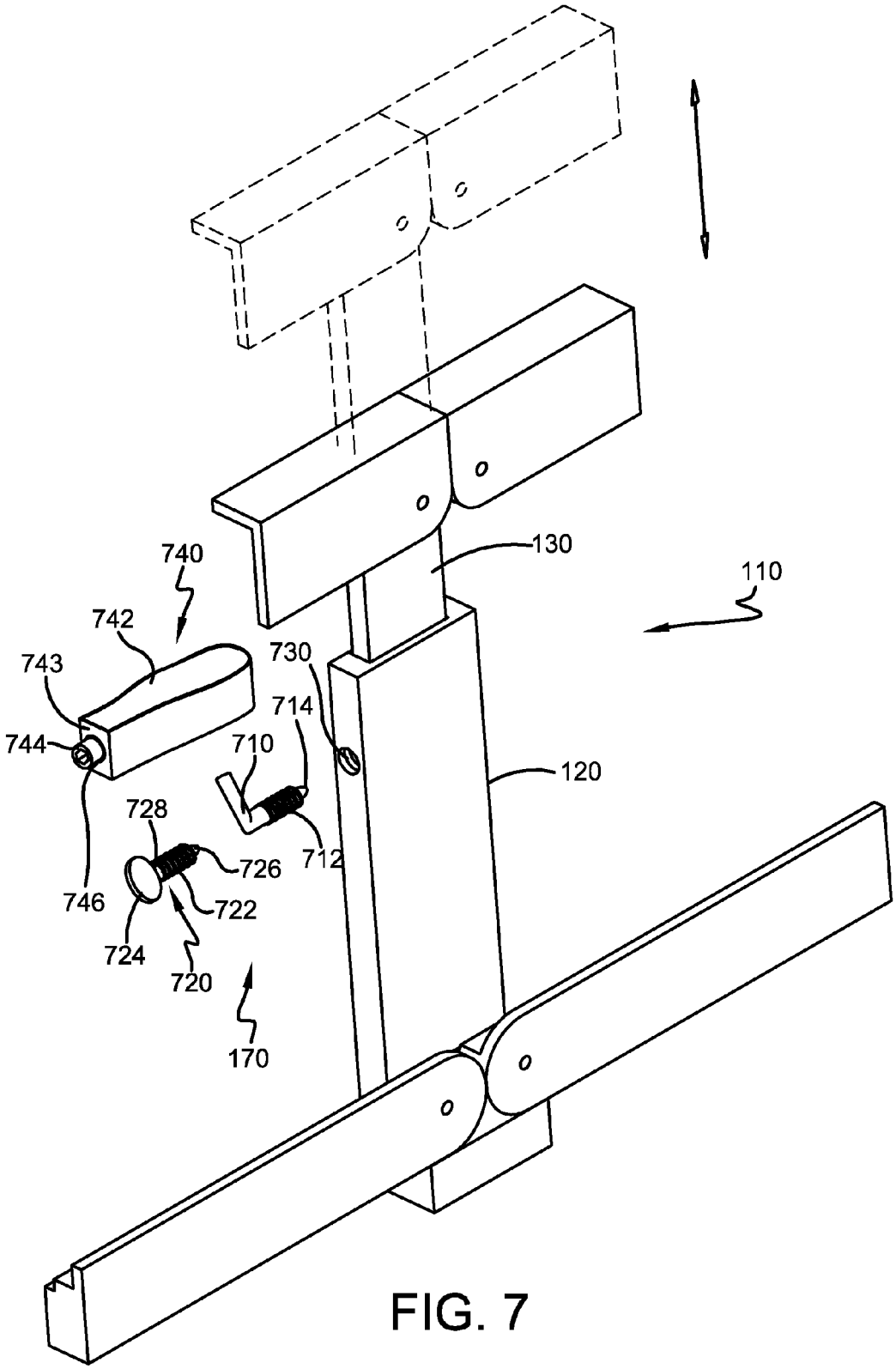
FIG. 7 is perspective view of an embodiment showing various locking means.

FIG. 7 is a view of an embodiment in a deployed configuration including a locking means 170. According to this embodiment, the locking means 170 fixes the length of the main beam 110 by locking the slide member 130 in a selected position relative to the receiving member 120. The locking means 170 may be disposed laterally on a side of the receiving member 120. In such embodiments, a portion of the locking means may be received by an aperture 730 defining a through-hole in the receiving member. Accordingly, the locking means 170 may travel through the aperture 730 and abut the slide member 130. Thus the locking means fixes the position of the slide member 130 using friction.

One skilled in the art will recognize that a variety of structures can be appropriate locking means 170. For instance, in some embodiments, the locking means 170 can comprise an L-shaped fastener 710 having a male thread 712 and a rounded tip 714 at one end of the fastener 710. In such embodiments the aperture 730 may include female threads adapted to mate with the male thread 712 of the locking means 170. Other embodiments can comprise a locking member 720 having a male-threaded outer sheath 722 receiving a shaft 728 in a spring-loaded relation. The shaft 728 may include a rounded tip 726 at one end for engaging the slide member 130, and a grip 724 at an opposing end adapted to be pulled by an operator to release the locking means 170. Still other embodiments 740 can include an elastic band 742 adapted to surround the receiving member 120. The elastic band 742 can have an integrated reinforced member 743 adapted to receive a shaft 744 in a seat 746 defined in the reinforced member 743. The reinforced member 743 retains the shaft 744 such that the elastic band can force the shaft 744 to abut the slide member 130 through the aperture 730, thereby locking the position of the slide member 130. In embodiments 740 having an elastic band, aperture 730 may or may not be threaded.

Figure 8:
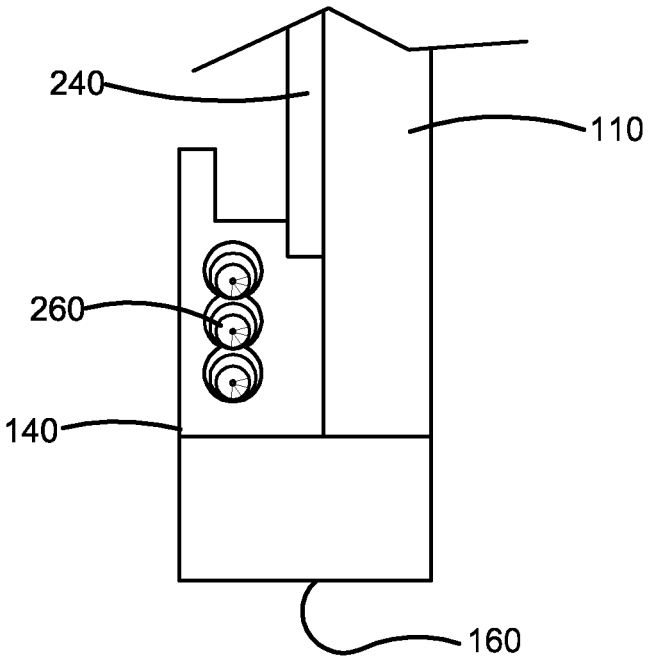
FIG. 8 is a view of recesses in the first support of an embodiment.

FIG. 8 is a close up of recesses 260 that can be included in some embodiments which are adapted to receive art implements such as, without limitation, paint brushes. The number of recesses 260 can vary from zero to as many as are spatially feasible. Furthermore, the recesses can be of various diameters, depths, or shapes to accommodate diverse art implements.

Figure 9A:
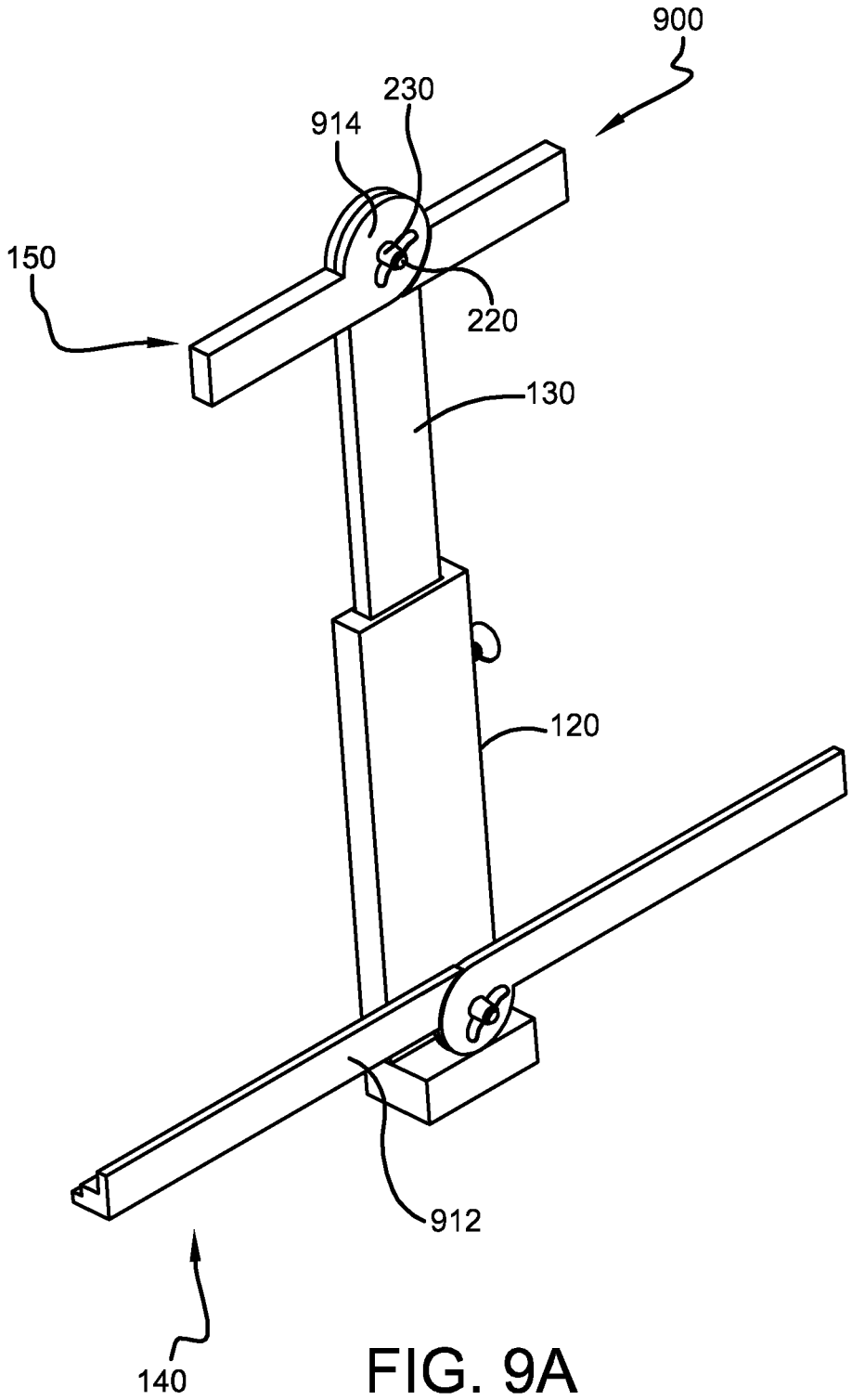
FIG. 9A is a perspective view of an embodiment having a double hinge.
Figure 9B:
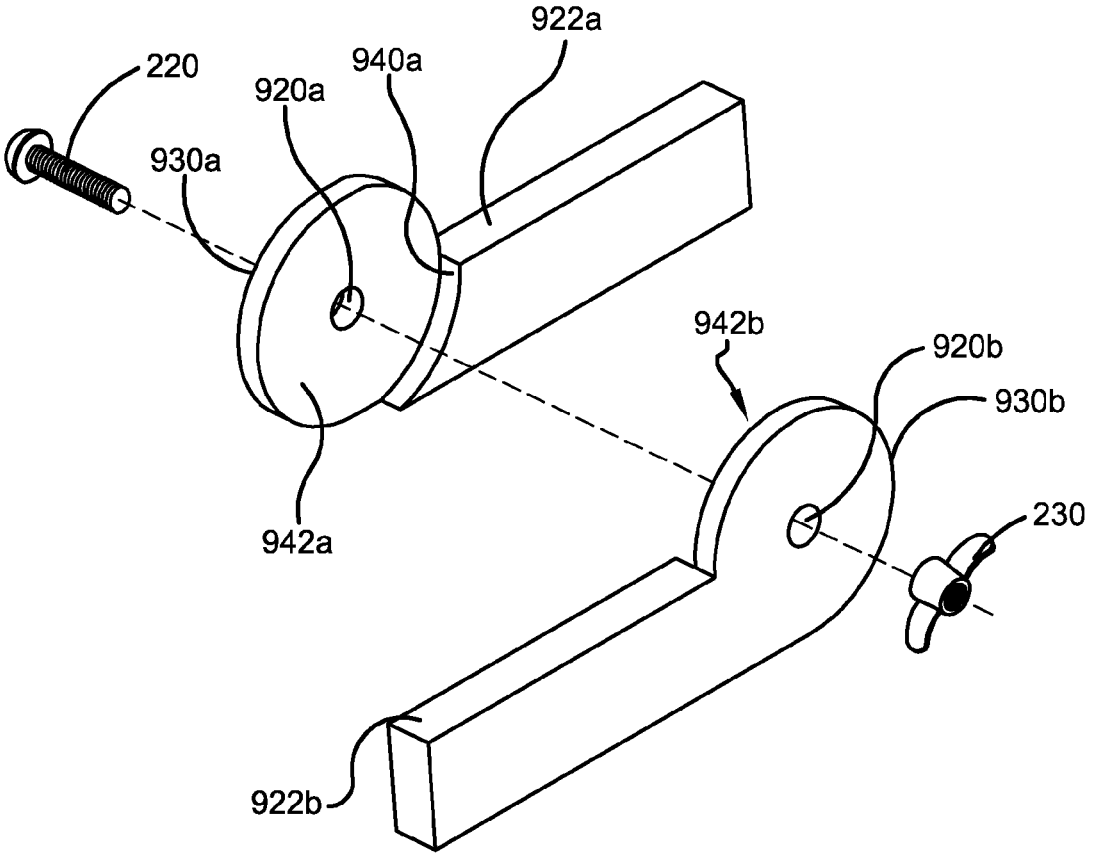
FIG. 9B is an exploded view of a generic double hinge.

FIG. 9A and FIG. 9B illustrate and embodiment 900 having double hinge elements 912, 914. According to FIG. 9A a first support 140 is hingedly joined to a receiving member 120 through a first double hinge 912. Similarly, a second support 150 is hingedly joined to a slide member 130 through a second double hinge 914. FIG. 9B is an exploded view of a generic support having a double hinge. According to FIG. 9B, a double hinge comprises a recess at one end of a first support 922*a* defining a curved sidewall 940*a* allowing for the rotation of the nose 930*b* of a mating support 922*b*. The first support 922*a* further includes a first rotational face 942*a* adapted to mate with the second rotational face 942*b* of the second support 922*b* in a slidable relation adapted to rotate about a bolt 220 which is fastened with a wing nut 230. The bolt 220 is received by apertures 920*a*, 920*b* defined in the respective first and second supports 922*a*, 922*b*.

Figure 10:
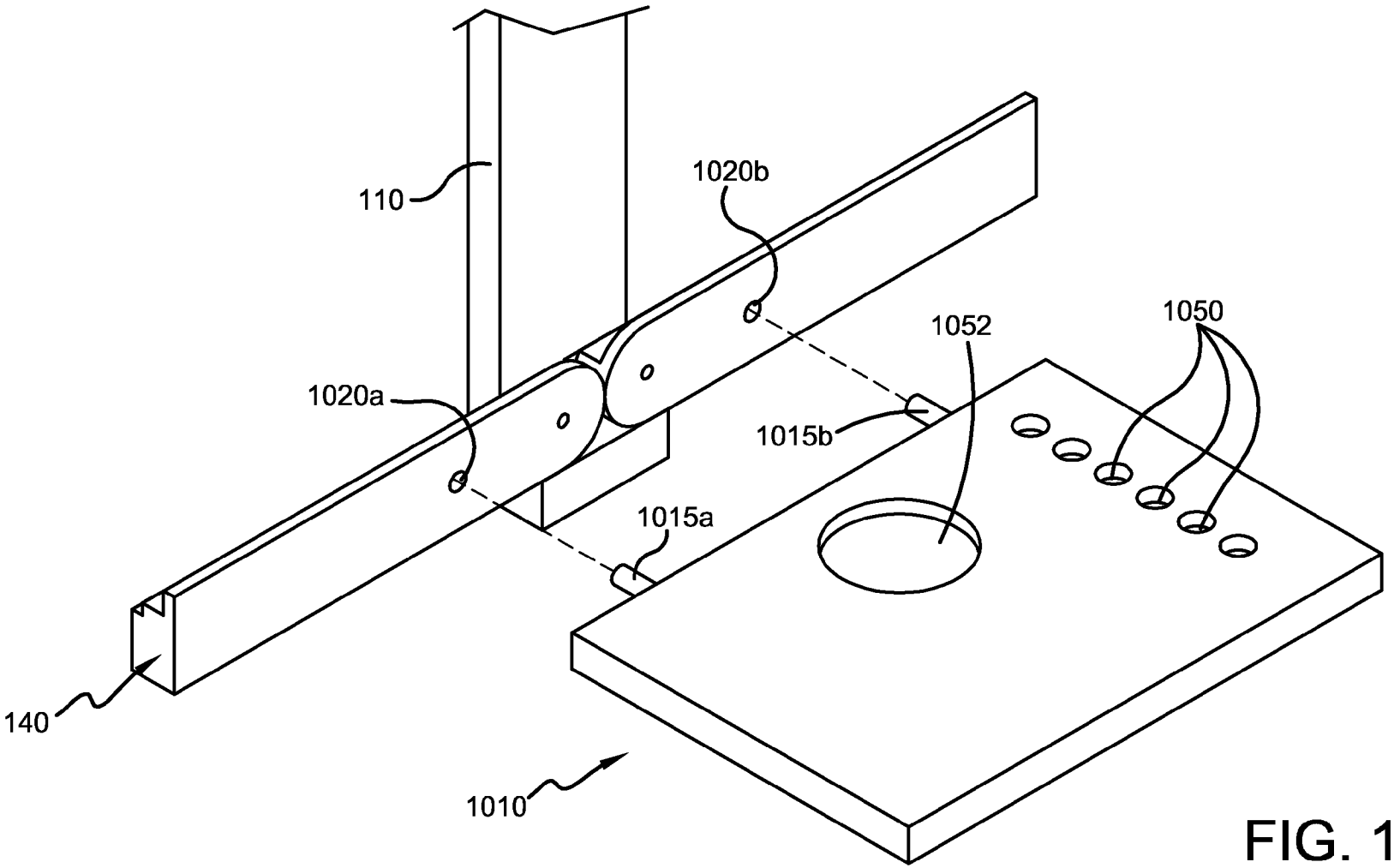
FIG. 10 is a partial view of an embodiment with a detachable platform

FIG. 10 is a partial view of an embodiment with a detachable platform 1010. According to FIG. 10, pegs 1015*a*, 1015*b* located on a side of the detachable platform 1010 are received by corresponding peg seats 1020*a*, 1020*b* in the first support 140. Thus, the detachable platform 1010 may be removably secured to the first support 140. In some embodiments, the detachable platform 1010 has apertures 1050 of various sizes, shapes, and/or arrangements to for receiving art implements such as, without limitation, paint brushes. For instance, an artist using several brushes in one project may temporarily store one or more brushes in the apertures 1050. Additionally, the embodiment of FIG. 10 includes a recess 1052 for receiving, for example, a bowl, cup or paint tray, which can be particularly useful for an artist working in water colors.

Figure 11:
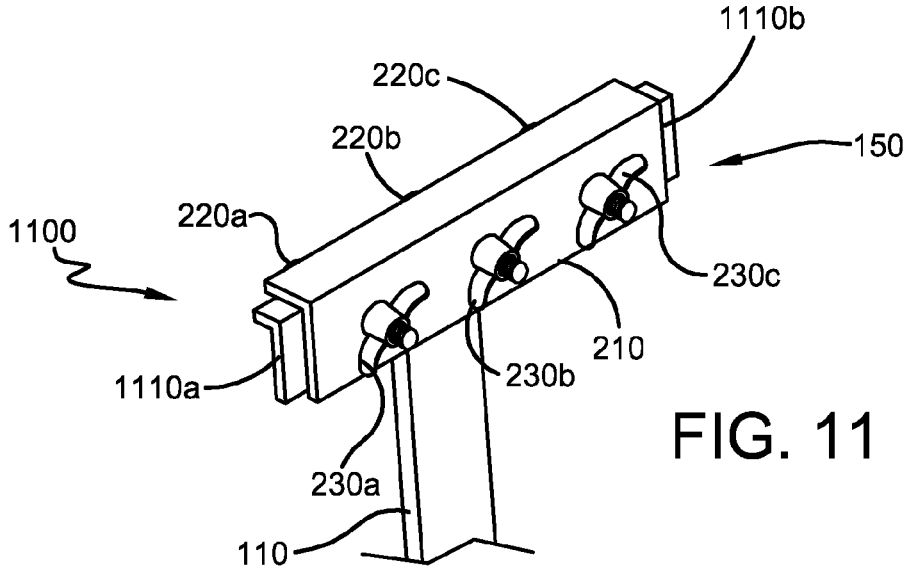
FIG. 11 is a close up of an embodiment of the second support in a retracted configuration.
Figure 12:
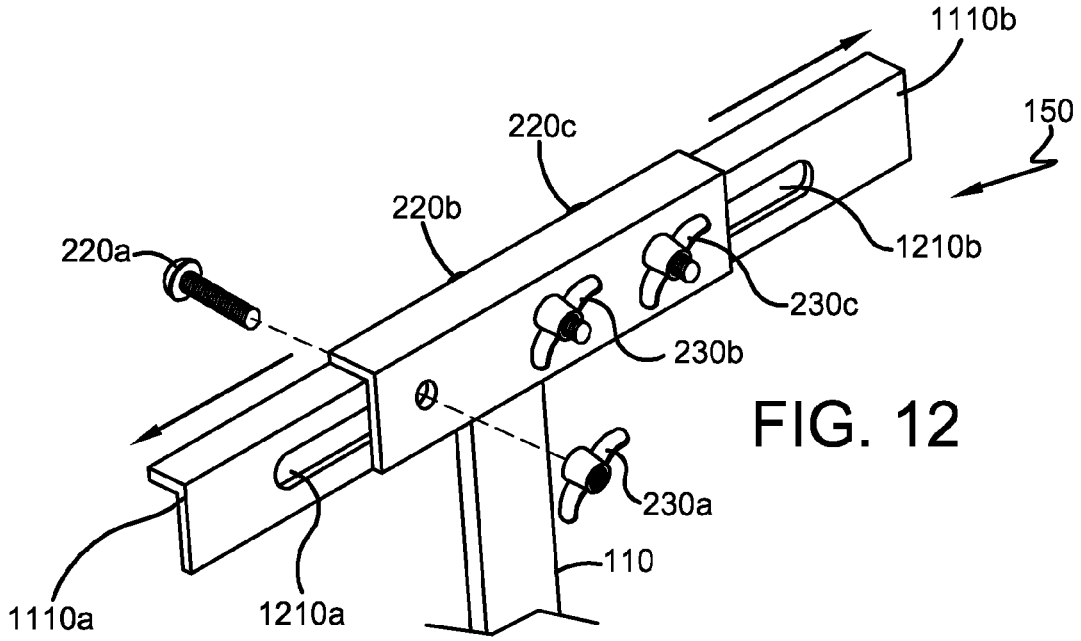
FIG. 12 is a close up of an embodiment of the second support in an extended configuration

FIG. 11 is a close up of a second support 150 of an embodiment. According to FIG. 11, the second support 150 in this embodiment comprises a retaining panel 210 and a pair of opposing extendible supports 1110*a* and 1110*b*. The second support 150 is shown mounted in a central location to the main beam 110 with a bolt 220 and wing nut 230. FIG. 11 shows the extendible supports 1110*a* and 1110*b* in a retracted configuration. FIG. 12 shows the embodiment of FIG. 11 with the opposing extendible supports 1110*a* and 1110*b* in an extended configuration exposing lateral apertures 1210*a* and 1210*b*. According to the embodiment illustrated in FIGS. 11 and 12, the opposing extendible supports 1110*a* and 1110*b* engage bolts 220*a-c* in a slidable relation. Furthermore, wing nuts 230*a-c* can reversibly engage bolts 220*a-c* in a tightened relation thus fixing the opposing extendible supports 1110*a* and 1110*b* in a selected configuration.

Figure 13:
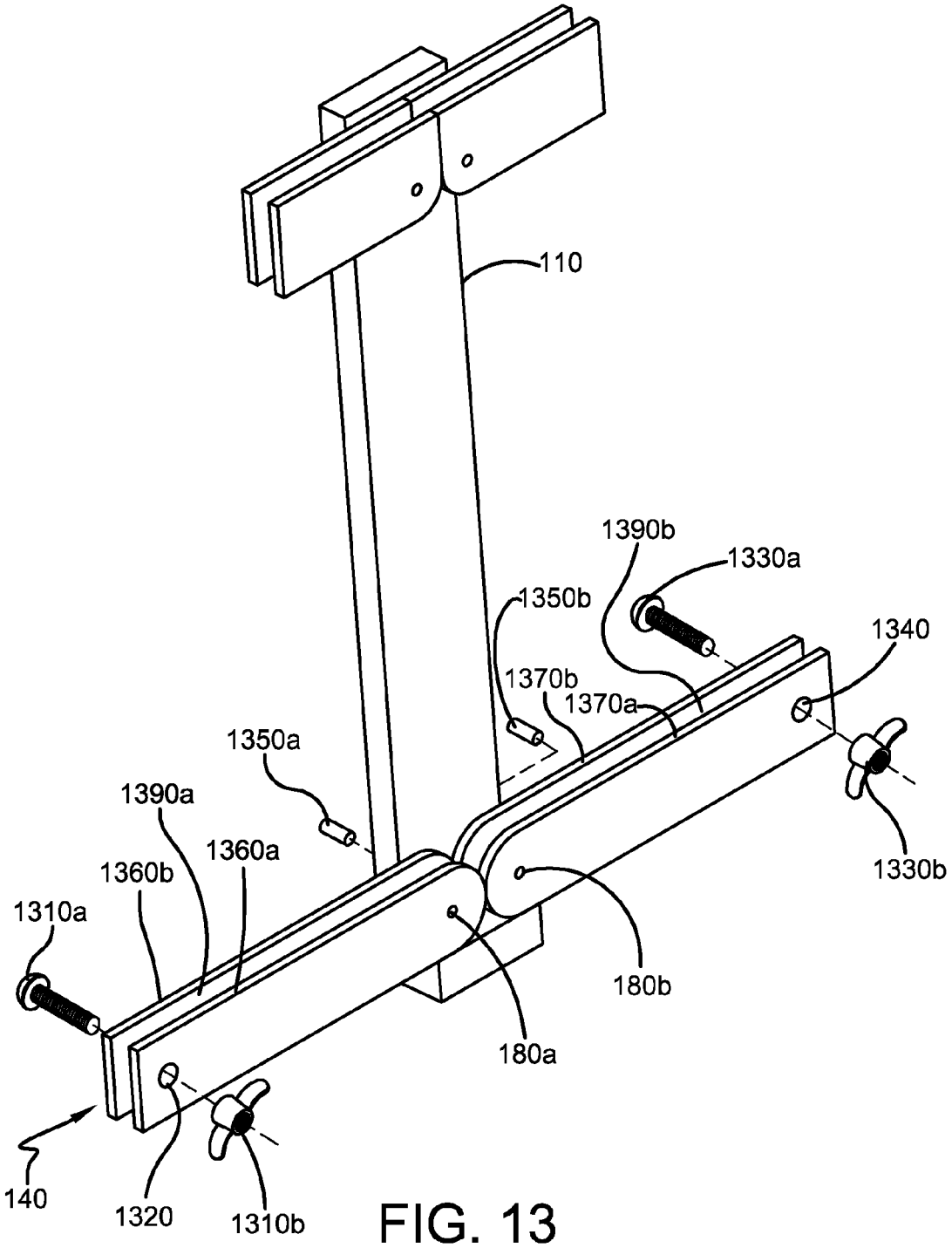
FIG. 13 is a perspective view of an embodiment with canvas compression.

FIG. 13 illustrates an embodiment adapted for canvas compression. According to FIG. 13 a first support 140 comprises pairs of parallel support arms 1360*a*, 1360*b*, 1370*a*, 1370*b* each pair defining a gap 1390*a*, 1390*b* therebetween. The size of the gaps 1390*a*, 1390*b* in the area of the hinges 180*a*, 180*b* may be defined by a pair of spacers 1350*a*, 1350*b*. In this embodiment, the first support 140 is adapted to retain a work piece such as, without limitation, a canvas by compressing the work piece between the pairs of parallel support arms 1360*a*, 1360*b*, 1370*a*, 1370*b*. Further according to this embodiment, each pair of parallel support arms 1360*a*, 1360*b*, 1370*a*, 1370*b* can include a bolt 1310*a*, 1330*a* and wing nut 1310*b*, 1330*b* received by apertures 1320, 1340. The bolt 1310*a*, 1330*a* and wing nut 1310*b*, 1330*b* may be positioned at an end of the first support 140 generally opposing the hinges 180*a*, 180*b*. Furthermore, the bolt 1310*a*, 1330*a* and wing nut 1310*b*, 1330*b* may be adapted to increase and/or decrease the size of the gaps 1390*a*, 1390*b* thus creating the capacity to reversibly hold a work piece in compression.

Embodiments of the invention having been described hereinabove, it will be apparent to those skilled in the art that the above methods and apparatuses may incorporate changes and modifications without departing from the general scope of the invention. It is intended to include all such modifications and alterations insofar as they come within the scope of the appended claims or the equivalents thereof.

I claim:

1. An easel, comprising:

a main beam having a first end and a second end spaced apart from the first end and defining a length, wherein the main beam comprises a receiving member and a slide member, the receiving member defining, and at least partially enclosing, a slide retaining space adapted to receive the slide member in a slidable retaining relation, wherein the slide member can retract into the slide retaining space reducing the overall length of the main beam, and the slide member can extend out of the slide retaining space increasing the overall length of the main beam;

a first support attached to an end of the main beam, the first support defining a first retaining trough, the first retaining trough running at least part of a length of the first support, and the first retaining trough being bounded at least by a portion of a face of the first support and a portion of a face of the main beam, wherein the first retaining trough is adapted to receive a work piece defined by an artist's canvas in a retaining relation;

a second support attached to an end of the main beam opposing the end to which the first support is attached, the second support defining a second retaining trough, the second retaining trough running at least part of a length of the second support and the second retaining trough being bounded by at least a portion of a face of the second support and a portion of a face of the main beam, the shortest distance between the face of the second support and the face of the main beam defining a width of the second retaining trough, wherein the width of the second retaining trough is adjustable according to a width adjustment means, wherein the second retaining member is adapted to receive a work piece defined by an artist's canvas in a compressive retaining relation; and a base fixedly attached to an end of the main beam, the base having a first face in contact with the main beam and through which the base is attached to the main beam, and the base having a second face spaced apart from, and generally parallel to, the first face, wherein the second face further includes a means for receiving a stand in a supportive relation.

2. The easel of claim 1, further comprising a means for fixing the position of the slide member relative to the receiving member, thereby fixing the overall length of the main beam.

3. An easel, comprising:

a main beam having a first end and a second end spaced apart from the first end and defining a length;

a first support attached to an end of the main beam, the first support defining a first retaining trough, the first retaining trough running at least part of a length of the first support, and the first retaining trough being bounded at least by a portion of a face of the first support and a portion of a face of the main beam, wherein the first retaining trough is adapted to receive a work piece defined by an artist's canvas in a retaining relation, wherein the first support comprises a pair of supports each defining an inner end and an outer end, the pair of supports each being hingedly attached through their inner ends to the main beam at opposing sides of the main beam;

a second support attached to an end of the main beam opposing the end to which the first support is attached, the second support defining a second retaining trough, the second retaining trough running at least part of a length of the second support and the second retaining trough being bounded by at least a portion of a face of the second support and a portion of a face of the main beam, the shortest distance between the face of the second support and the face of the main beam defining a width of the second retaining trough, wherein the width of the second retaining trough is adjustable according to a width adjustment means, wherein the second retaining member is adapted to receive a work piece defined by an artist's canvas in a compressive retaining relation; and a base fixedly attached to an end of the main beam, the base having a first face in contact with the main beam and through which the base is attached to the main beam, and the base having a second face spaced apart from, and generally parallel to, the first face, wherein the second face further includes a means for receiving a stand in a supportive relation.

4. An easel, comprising:

a main beam having a first end and a second end spaced apart from the first end and defining a length;

a first support attached to an end of the main beam, the first support defining a first retaining trough, the first retaining trough running at least part of a length of the first support, and the first retaining trough being bounded at least by a portion of a face of the first support and a portion of a face of the main beam, wherein the first retaining trough is adapted to receive a work piece defined by an artist's canvas in a retaining relation;

a second support attached to an end of the main beam opposing the end to which the first support is attached, the second support defining a second retaining trough, the second retaining trough running at least part of a length of the second support and the second retaining trough being bounded by at least a portion of a face of the second support and a portion of a face of the main beam, the shortest distance between the face of the second support and the face of the main beam defining a width of the second retaining trough, wherein the width of the second retaining trough is adjustable according to a width adjustment means, wherein the second retaining member is adapted to receive a work piece defined by an artist's canvas in a compressive retaining relation, wherein the second support comprises a pair of supports each defining an inner end and an outer end, the pair of supports each being hingedly attached through their inner ends to the main beam at opposing sides of the main beam; and a base fixedly attached to an end of the main beam, the base having a first face in contact with the main beam and through which the base is attached to the main beam, and the base having a second face spaced apart from, and generally parallel to, the first face, wherein the second face further includes a means for receiving a stand in a supportive relation.

5. An easel, comprising:

a main beam having a first end and a second end spaced apart from the first end, the main beam defining a length, wherein the main beam comprises a receiving member and a slide member, the receiving member defining, and at least partially enclosing, a slide retaining space adapted to receive the slide member in a slidable retaining relation, wherein the slide member can retract into the slide retaining space reducing the overall length of the main beam, and the slide member can extend out of the slide retaining space increasing the overall length of the main beam;

a first support attached to an end of the main beam, the first support defining a first retaining trough, the first retaining trough running at least part of a length of the first support, and the first retaining trough being bounded at least by a portion of a face of the first support and a portion of a face of the main beam, wherein the first retaining trough is adapted to receive a work piece defined by an artist's canvas in a retaining relation, and wherein the first support comprises a pair of supports each defining an inner end and an outer end, the pair of supports each being hingedly attached through their inner ends to the main beam at opposing sides of the main beam;

a second support attached to an end of the main beam opposing the end to which the first support is attached, the second support defining a second retaining trough, the second retaining trough running at least part of a length of the second support and the second retaining trough being bounded by at least a portion of a face of the second support and a portion of a face of the main beam, the shortest distance between the face of the second support and the face of the main beam defining a width of the second retaining trough, wherein the width of the second retaining trough is adjustable according to a width adjustment means, wherein the second retaining member is adapted to receive a work piece defined by an artist's canvas in a compressive retaining relation, and wherein the second support comprises a pair of supports each defining an inner end and an outer end, the pair of supports each being hingedly attached through their inner ends to the main beam at opposing sides of the main beam; and a base fixedly attached to an end of the main beam, the base having a first face in contact with the main beam and through which the base is attached to the main beam, and the base having a second face spaced apart from, and generally parallel to, the first face, wherein the second face further includes a means for receiving a stand in a supportive relation.

6. The easel of claim 5, further comprising a means for fixing the position of the slide member relative to the receiving member, thereby fixing the overall length of the main beam.

* * * * *